US005324045A

United States Patent [19]

Trawick et al.

[11] Patent Number: 5,324,045

[45] Date of Patent: Jun. 28, 1994

[54] BLOW OUT GAME

[76] Inventors: Phyllis A. Trawick; Charles V. Wysinger, both of 1023 W. 102nd St., #5, Los Angeles, Calif. 90044

[21] Appl. No.: 65,774

[22] Filed: May 24, 1993

[51] Int. Cl.[5] ..... A63F 9/00

[52] U.S. Cl. ..... 273/458; 137/223; 251/303; 417/568; 446/180; 446/224

[58] Field of Search ..... 273/458; 446/180, 181, 446/186, 189, 220, 224; 417/544, 568; 137/228, 223; 251/303; 152/415

[56] References Cited

U.S. PATENT DOCUMENTS

| | | | |
|---|---|---|---|
| 488,071 | 12/1892 | Hodgson | 446/224 X |
| 1,024,683 | 4/1912 | Gray | 251/303 X |
| 1,351,173 | 8/1920 | Kirkpatrick | 251/303 X |
| 1,394,207 | 10/1921 | Medine | 251/303 X |
| 2,516,371 | 7/1950 | Crockett | 417/568 |
| 2,608,795 | 9/1952 | Marcell | 446/189 X |
| 2,636,315 | 4/1953 | Morsch | 446/220 X |
| 2,643,598 | 6/1953 | Carroll | 446/220 X |
| 3,062,542 | 11/1962 | Evancha | 273/458 X |
| 3,685,825 | 8/1972 | Dorazio . | |
| 4,169,593 | 10/1979 | Wood . | |
| 4,201,387 | 5/1980 | Revermann et al. . | |
| 4,826,161 | 5/1989 | Rookmaaker . | |
| 4,957,299 | 9/1990 | Richardson . | |
| 5,125,623 | 6/1992 | Kiedinger | 251/303 X |

FOREIGN PATENT DOCUMENTS

| | | | |
|---|---|---|---|
| 489760 | 10/1918 | France | 417/568 |
| 14013 | 2/1979 | Japan | 417/568 |

*Primary Examiner*—Paul E. Shapiro

*Attorney, Agent, or Firm*—Harris, Wallen, MacDermott & Tinsley

[57] ABSTRACT

A game apparatus including a pump carried in a housing and having a chamber with air inlet and air outlet and a piston sliding in the chamber, a release valve, an inflation nozzle for a balloon, and a pipeline in the housing connecting the chamber air outlet, the release valve, and the inflation nozzle. A release valve for the game apparatus including a valve seat, a deflate arm pivotally mounted on the housing, a valve carried on the deflate arm, and a spring engaging the deflate arm and housing for urging the valve onto the valve seat in sealing condition.

6 Claims, 1 Drawing Sheet

FIG. 1
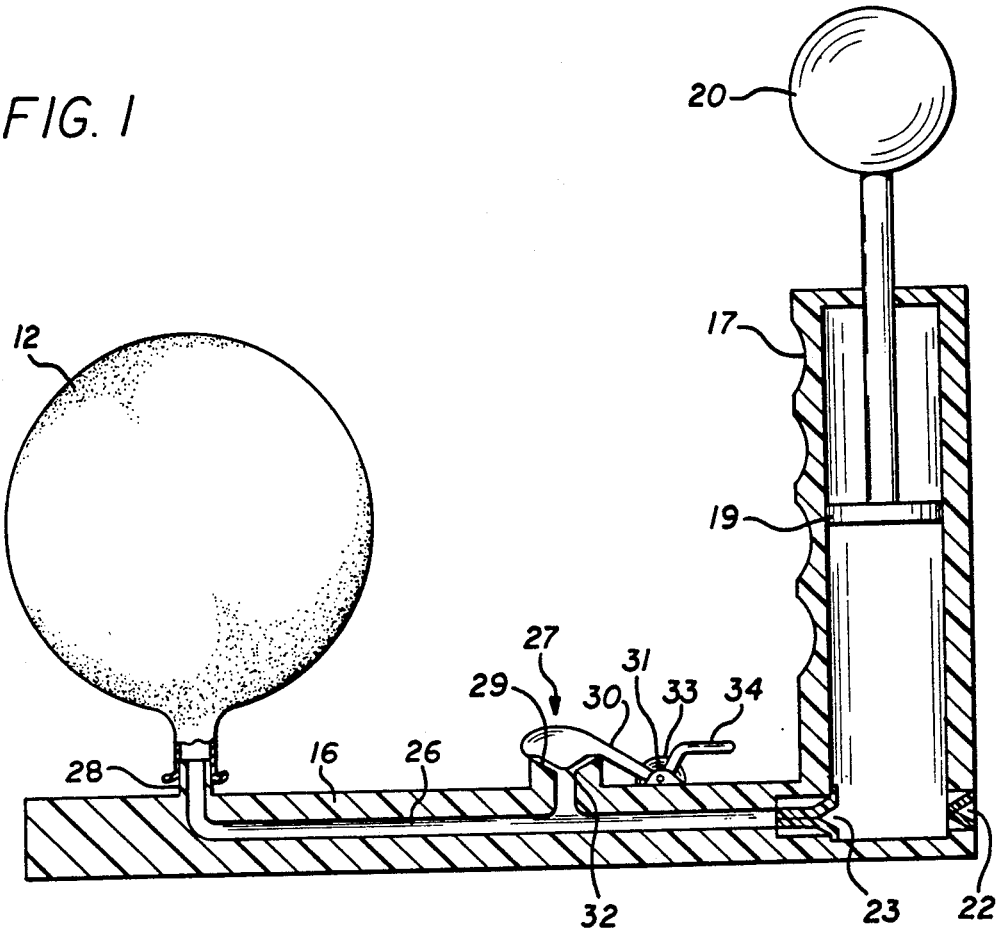
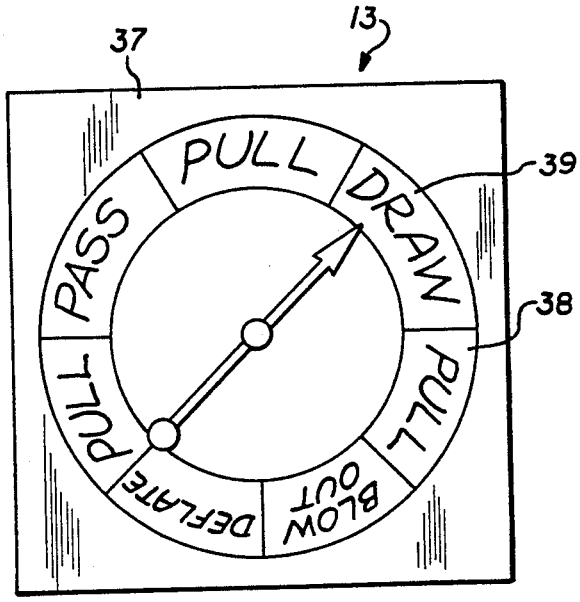
FIG. 2
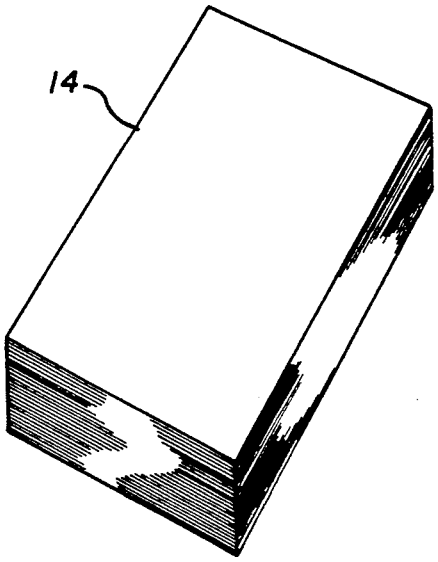
FIG. 3

BLOW OUT GAME

BACKGROUND OF THE INVENTION

This invention relates to a game apparatus and in particular to a game for two or more players, with each player having a set of the apparatus.

The game apparatus includes a mechanism for controlling the inflation of a balloon, with the object of the game being for each player to maintain his or her balloon intact until all the other player's balloons have burst.

A variety of games utilizing balloons are shown in earlier patents. U.S. Pat. No. 4,201,387 includes an apparatus for compressing a balloon until it bursts, with a game board and pair of dice, with players turning the handle of a press to apply pressure to the inflated balloon.

U.S. Pat. No. 4,957,299 utilizes the exhaust from an inflated balloon to propel the balloon toward a game board.

U.S. Pat. No. 3,685,825 shows a game starting with inflated balloons, with a weighted needle positioned above each balloon and with the addition of weights causing one of the balloons to be punctured.

U.S. Pat. No. 4,826,161 shows another version or a game for puncturing an inflated balloon by applying pressure pins through a sleeve with the balloon therein.

U.S. Pat. No. 4,169,593 utilizes an inflated balloon with a diaphragm carrying pins positioned above the balloon, with the diaphragm being depressed by marbles dropped through holes of a board positioned above the diaphragm.

None of these prior patents show a game wherein individual players have balloons which are inflated and deflated by the players' actions, with the actions directed by other game devices such as spinners and cards.

SUMMARY OF THE INVENTION

Accordingly, it is an object of the present invention to provide a new and improved balloon game wherein each player inflates and deflates balloons and in particular, where the inflation and deflation is controlled by instructions, as from a spinner and a deck of cards.

These and other objects, advantages, features and results will more fully appear in the course of the following description.

In the preferred embodiment, the game apparatus includes a pump carried in a housing and having a chamber with air inlet and air outlet and a piston sliding in the chamber, a release valve, an inflation nozzle for a balloon, and a pipeline in the housing connecting the chamber air outlet, the release valve, and the inflation nozzle. Preferably an inlet check valve is provided at the chamber air inlet and an outlet check valve is provided at the chamber air outlet.

The release valve preferably includes a valve seat, a deflate arm pivotally mounted on the housing, a valve carried on the deflate arm, and a spring engaging the deflate arm and housing for urging the valve onto the valve seat in sealing condition.

BRIEF DESCRIPTION OF THE DRAWING

FIG. 1 is a side view, partly in section, showing a balloon and a pumping apparatus for inflating and deflating the balloon, and incorporating the presently preferred embodiment of the invention;

FIG. 2 is a top view of a spinner with instruction ledgends suitable for use with the apparatus of FIG. 1; and FIG. 3 is a perspective view of a deck of cards with instructions suitable for use with the spinner and apparatus of FIGS. 1 and 2.

DESCRIPTION OF THE PREFERRED EMBODIMENT

The game includes a balloon holder 11 with balloon 12, a spinner 13 and a deck of cards 14. The balloon holder includes a housing 16 with a pump 17 having a chamber 18 with a piston 19 sliding therein, with the piston driven by a knob or handle 20.

The chamber 18 has an air inlet 22 and an air outlet 23, preferably with check valves, for air flow into the chamber when the piston is raised and air flow from the chamber when the piston is lowered. Alternatively, the air inlet 22 could be positioned in the piston or could be a leakage path between the piston and chamber.

A pipeline 26 in the housing 16 provides for air flow between the chamber air outlet 23, a release valve 27, and a balloon inflation nozzle 28. In the preferred design, the release valve includes a valve seat 29 and a deflate arm 30 pivotally mounted on the housing by a pivot pin 31 and carrying a valve member 32 for engaging the valve seat 29. A spring 33 is positioned around the pivot pin 31 and engages the housing 16 and the arm 30 for urging the arm counter-clockwise as viewed in FIG. 1 to engage the valve 32 with the seat 29 and block air flow through the release valve.

In operation, the neck of the balloon 12 is placed over the nozzle 28. Operating the pump by pushing downward on the piston 19 pumps air from the chamber 18 into the balloon 12 to inflate the balloon. Pressing downward on the handle 34 of the arm 30 of the release valve raises the valve 32 from the seat 29, with air flow outward deflating the balloon.

The spinner 13 includes a plate 37 with a needle 38 pivotally mounted on the plate. Game instruction legends 39 are provided in arcuate segments on the plate.

The holder 11, a balloon 12, the spinner 13 and the deck of cards 14 may be used in playing a game sometimes known as BLOW-OUT. The game can be played by two or more players with each player having a holder and a deck of cards. A single spinner can be used by all the players. Typically a game set will be packaged with four holders, four decks of cards, a spinner and a quantity of balloons.

One set of rules for use of the apparatus is as follows.

The object of the game is to avoid bursting your balloon before all the other balloons burst. The only player left with his or her balloon intact is the winner.

Each player has seventeen cards in his or her deck, and each player has an assigned color, such as red, blue, green or yellow. Preferably, the color of each player's balloon matches the player's color.

Ten of the seventeen cards in each deck are numbered 1–10 and instruct the player drawing the card to push the pump handle down a corresponding number of strokes to inflate his or her balloon.

Also each player's deck will have two cards of each of the other players' color with numbers, such as 1 and 3. For example, if a player is red and picks a blue card with number 1, the blue player must pump his or her pump one time. If a player is red and picks a green card with number 3, the green player must pump three times. Once a card is picked, it cannot be reused until the player's last card is picked. Then the player's deck is reshuffled and play resumes.

The seventeenth card in each player's deck is a CHOICE card. Drawing this card permits the player to choose another player who must inflate his or her balloon. Typically, the CHOICE card carries a number such as 2, which means the chosen player must inflate or pump two times.

The spinner controls play of the game. The players take turns spinning the needle and then following the instructions indicated by the needle when it stops. The legends on the spinner direct the action. PULL means pull one card from the spinning player's deck and follow the instructions on the card, BLOW-OUT means inflate the balloon until it bursts and the player is out of the game. DEFLATE means release all air from the balloon. PASS means pass to the next player without taking any further action. DRAW means every player must inflate his or her balloon one pump. Of course, the size of the segments and the legends on the segments can be varied as desired.

We claim:

1. In a game apparatus, the combination of:
- a housing;
- a pump carried in said housing and having a chamber with air inlet and air outlet and a piston sliding in said chamber;
- a release valve;
- an inflation nozzle for a balloon;
- a pipeline in said housing connecting said chamber air outlet, said release valve, and said inflation nozzle; and
- a spinner having a plate with a needle rotatably mounted thereon and with said plate having a plurality of playing instructions printed thereon in segments.

2. A game apparatus as defined in claim 1 including an inlet check valve at said chamber air inlet and an outlet check valve at said chamber air outlet.

3. A game apparatus as defined in claim 1 wherein said release valve includes:
- a valve seat;
- a deflate arm pivotally mounted on said housing;
- a valve carried on said deflate arm; and
- a spring engaging said deflate arm and housing for urging said valve onto said valve seat in sealing condition.

4. A game apparatus as defined in claim 1 including a balloon having an inflation neck positioned over said inflation nozzle.

5. A game apparatus as defined in claim 1 including a deck of cards having playing instructions thereon, with one group of said cards having a set of numbers and another group of said cards having a set of colors.

6. In a game apparatus, the combination of:
- a housing;
- a pump carried in said housing and having a chamber with air inlet and air outlet and a piston sliding in said chamber;
- a release valve including a valve seat, a deflate arm pivotally mounted on said housing, a valve carried on said deflate arm, and a spring engaging said deflate arm and housing for urging said valve onto said valve seat in sealing condition,
- an inflation nozzle for a balloon having an inflation neck positioned over said inflation nozzle;
- a pipeline in said housing connecting said chamber air outlet, said release valve, and said inflation nozzle;
- a spinner having a plate with a needle rotatably mounted thereon and with said plate having a plurality of playing instructions printed thereon in segments; and
- a deck of cards having playing instructions thereon, with one group of said cards having a set of numbers and another group of said cards having a set of colors.

* * * * *